US005678918A

United States Patent [19]

Lin

[11] Patent Number: 5,678,918

[45] Date of Patent: Oct. 21, 1997

[54] LAMP STAND

[76] Inventor: Rich Lin, No. 185, Dah Guan Road, Section 2, Panchiao, Taipei Hsien, Taiwan

[21] Appl. No.: 646,890

[22] Filed: May 8, 1996

[51] Int. Cl.[6] ..... F21V 33/00

[52] U.S. Cl. ..... 362/96; 362/101; 362/806; 40/406; 40/439; 40/441

[58] Field of Search ..... 362/101, 806, 362/410, 96, 124, 35, 276, 395; 40/406, 409, 439, 441

[56] References Cited

U.S. PATENT DOCUMENTS 4,736,278 4/1988 Wolens et al. ..... 362/806

5,010,460 4/1991 Lin ..... 362/101

5,272,604 12/1993 Lin ..... 362/101

FOREIGN PATENT DOCUMENTS 862801 11/1952 Germany ..... 362/101

*Primary Examiner*—James C. Yeung

*Attorney, Agent, or Firm*—Bacon & Thomas

[57] ABSTRACT

Disclosed is a lamp stand which mainly includes a clear and closed tubular container as its main body. A rotational shaft with blades is mounted in the tubular container and can be driven by magnetic rotational members to rotate and stir liquid contained in the container, so that currents looking like flowing cloud or floating mists are presented in the container forming the lamp stand, providing changeful and beautiful view.

7 Claims, 9 Drawing Sheets

LAMP STAND

BACKGROUND OF THE INVENTION

There are a variety of desktop ornaments containing liquid to show a flowing and changeable beauty of liquid within the ornaments. One of such ornaments has been referred to as a "flowing cloud former". This "flowing cloud former" has a clear and upright long-tubular liquid container with two air chambers and two air ports separately provided at an upper and a lower ends thereof. Some kind of liquid looking like flowing cloud or mist (a liquid blended with colored fine powders) is contained in the tubular container. When the container is turned upside down, air bubbles in the liquid keep moving upward and thereby disturb the liquid, causing changeful flows in the mist-like liquid. The changeful flows in the liquid can be seen through the clear container and make the container looking like a smooth marble with changeable grains on its surface. To produce the flowing and changeful grains or cloud in the liquid, the "flowing cloud former" must be frequently turned upside down and is therefore not so practical in use. It is therefore desirable to develop an improved "flowing cloud former" which shows continuous and dynamic views while it does not need to be turned upside down now and then. And, it is also desirable that such improved "flowing cloud former" can be used in combination with a power supply to function like a lamp stand to have added value.

SUMMARY OF THE INVENTION

A primary object of the present invention is to provide a novel decoration which includes a closed and clear container containing liquid which can be stirred to present cloud-like flows by a rotatable shaft with blades driven by a motor and two sets of magnetic rotational members.

Another object of the present invention is to provide a novel lamp stand which uses a closed and clear container containing flowing liquid as its main body, such that the flowing liquid in the lamp stand may be stirred by the same power supplied to the lamp to produce current like flowing cloud in the container.

The lamp stand according to the present invention includes a closed and clear tubular container serving as a main body of the lamp stand. Some kind of flowing liquid is filled in the tubular container. A driven magnetic rotational member is disposed inside the container at a bottom thereof and a driving magnetic rotational member is disposed within a lower seat outside and below the container corresponding to the driven magnetic rotational member. A rotational shaft in adequate length extends upward from the driven rotational member and has a plurality of blades provided thereto. A motor is disposed in the lower seat below the driving rotational member to rotate the latter. When a switch is turned on, the rotational shaft and the blades thereof are driven to rotate by the magnetic force of the driven and the driving magnetic rotational members actuated by the motor. At this point, the liquid in the container is stirred by the blades to produce changeful currents like flowing cloud or floating mists inside the container.

DETAILED DESCRIPTION OF THE PREFERRED EMBODIMENTS

Figure 1:
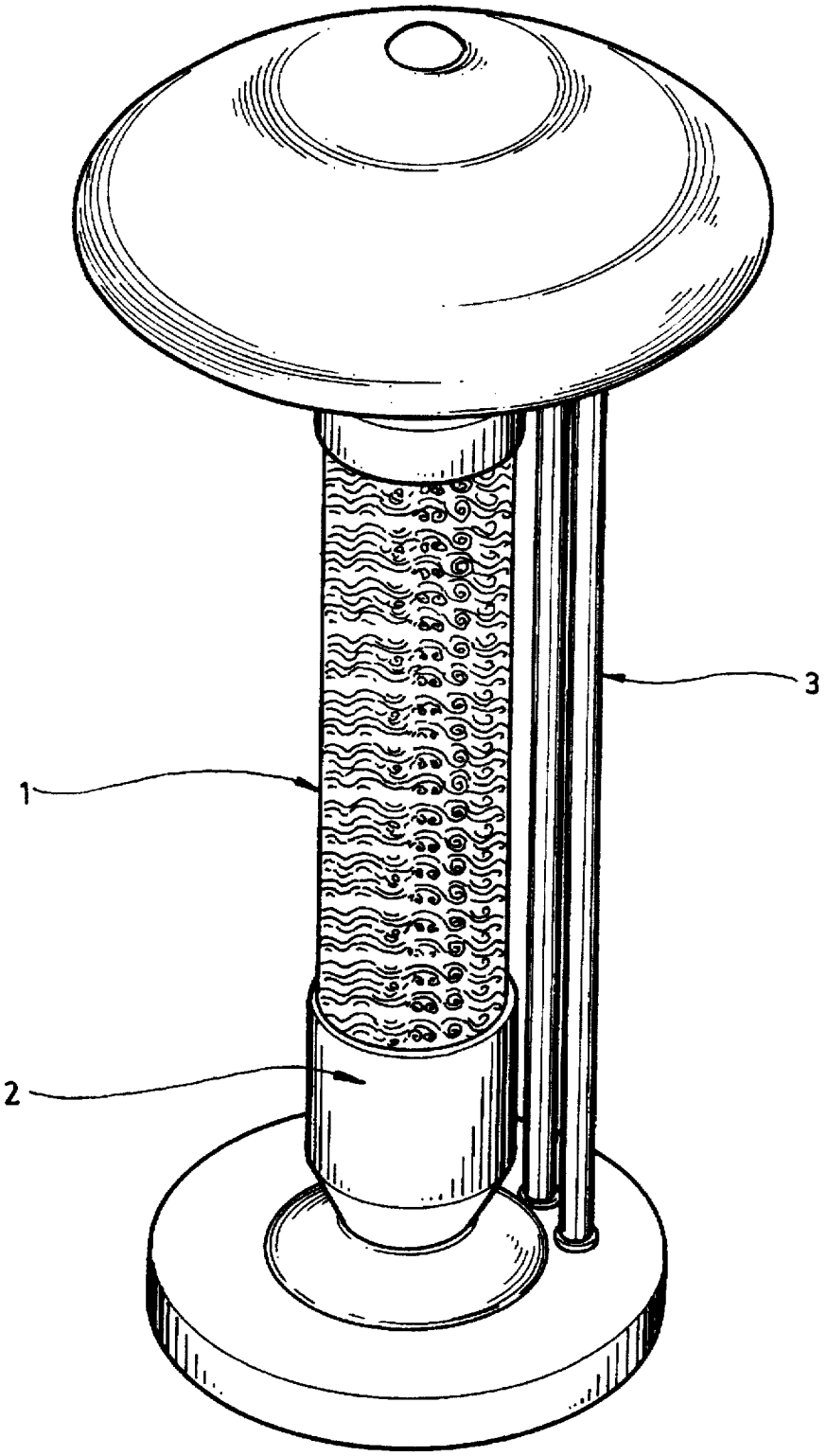
FIG. 1 is a perspective showing a first embodiment of the lamp stand according to the present invention.

Please refer to FIGS. 1, 2, 3, and 4 at the same time. The present invention is a lamp stand mainly including a liquid container 1, a lower seat 2, and one or more supporting members 3.

The liquid container 1 is made of clear material and is preferably in a tubular form. A driven magnetic rotational member 11 is disposed in the tubular container 1 at a bottom side thereof. A rotational shaft 12 extends upward from the rotational member 11 and has a plurality of blades 13 provided thereto. Two first shaft holders 14 separately connected to a top and a bottom covers 15 of the tubular container 1 respectively receive a top end of the rotational shaft 12 and a bottom end of the rotational member 11, such that the rotational shaft 12 and the rotational members 11 are rotatably supported between the top and the bottom covers 15 inside the container 1. The rotational member 11 is provided at an inner space with two symmetrically arranged magnets 111.

The lower seat 2 is connected to the bottom side of the tubular container 1 and accommodates therein a driving magnetic rotational member 21, a motor 23, and some other general parts, such as a base member 24, a weight steel plate 25, and electric wires 26. The driving magnetic rotational member 21 is provided at an inner space with two symmetrically arranged magnets 211 corresponding to the two magnets 111 in the driven rotational member 11, so that the two magnetic rotational members 11, 21 mutually attract each other through the bottom cover 15. The rotational member 21 is also supported in the lower seat 2 by means of two second shaft holders 22. The lower second shaft holder 22 is connected to and driven by the motor 23 via a set of gears.

The supporting members 3 extend upward from the lower seat 2. Conductive wires pass through the supporting members 3 to connect to a socket 31 disposed to a top end of the supporting members 3. A lamp shade 32 is connected to the top end of the supporting members 3 above the socket 31. The supporting members 3 may be also connected to the container 1 so that the container 1 can stand more stably.

Figure 2:
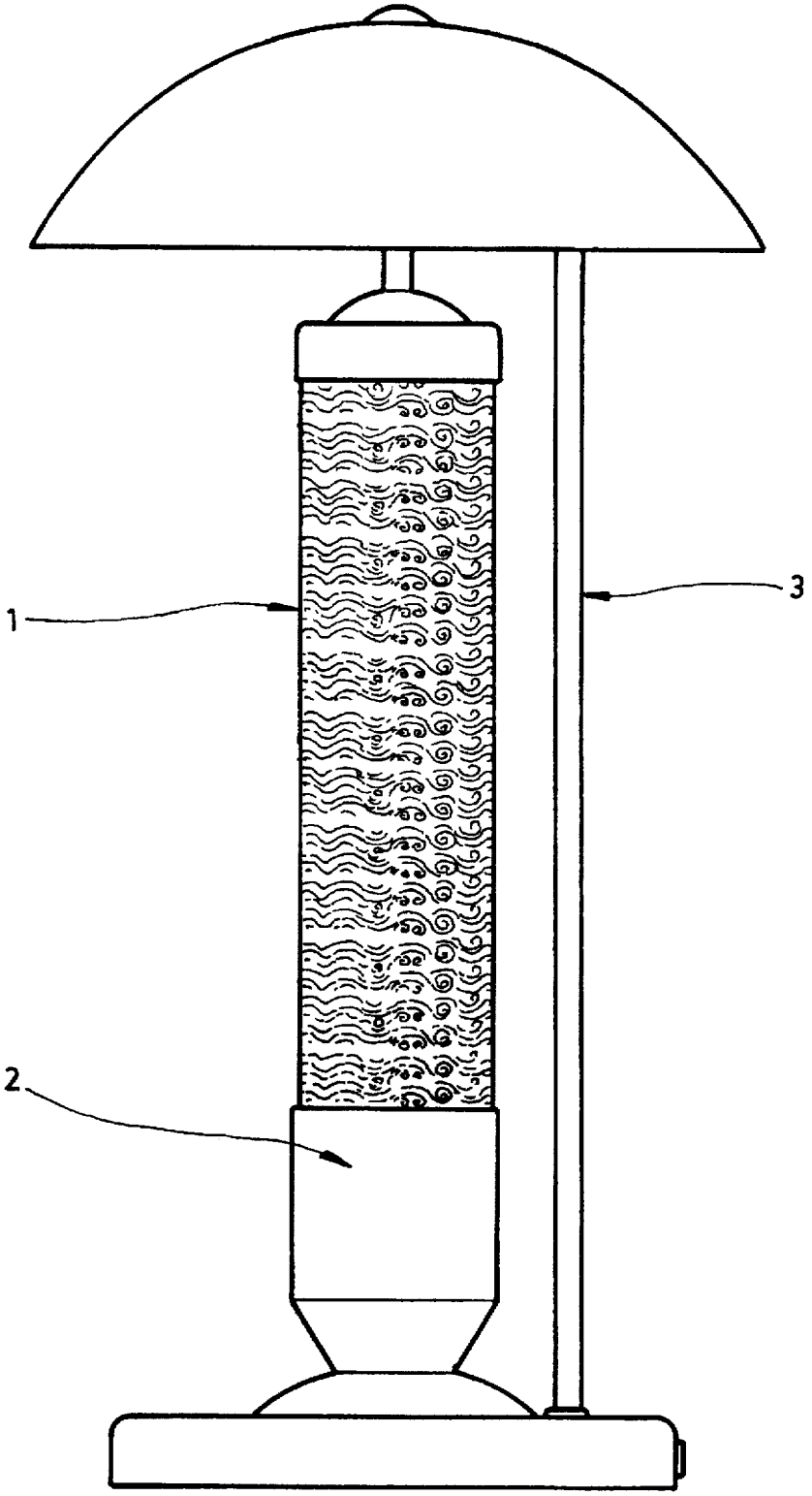
FIG. 2 is a front elevational view of the lamp stand of FIG. 1.
Figure 3:
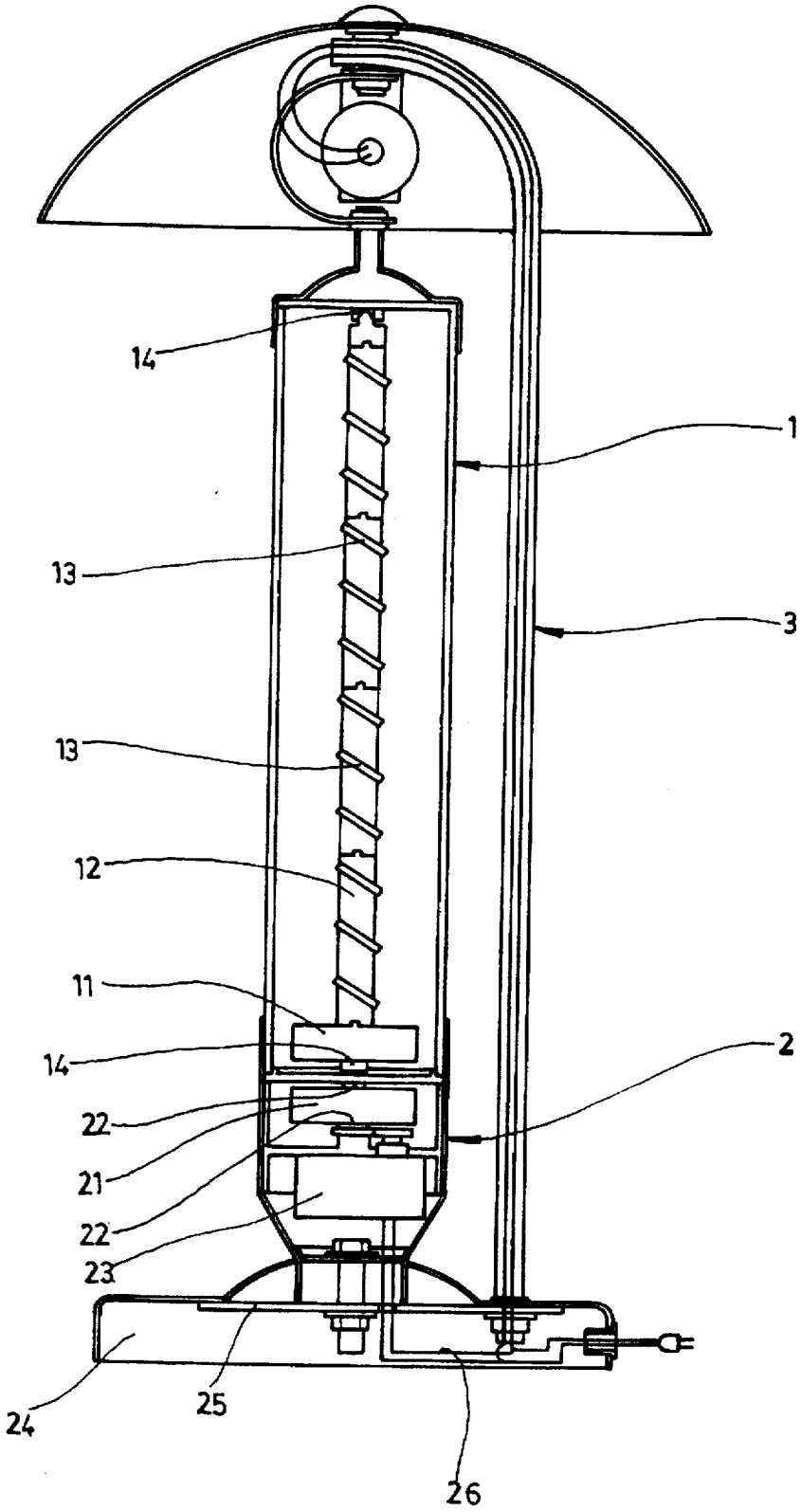
FIG. 3 is a front sectional view of the lamp stand of FIG. 1.
Figure 4:
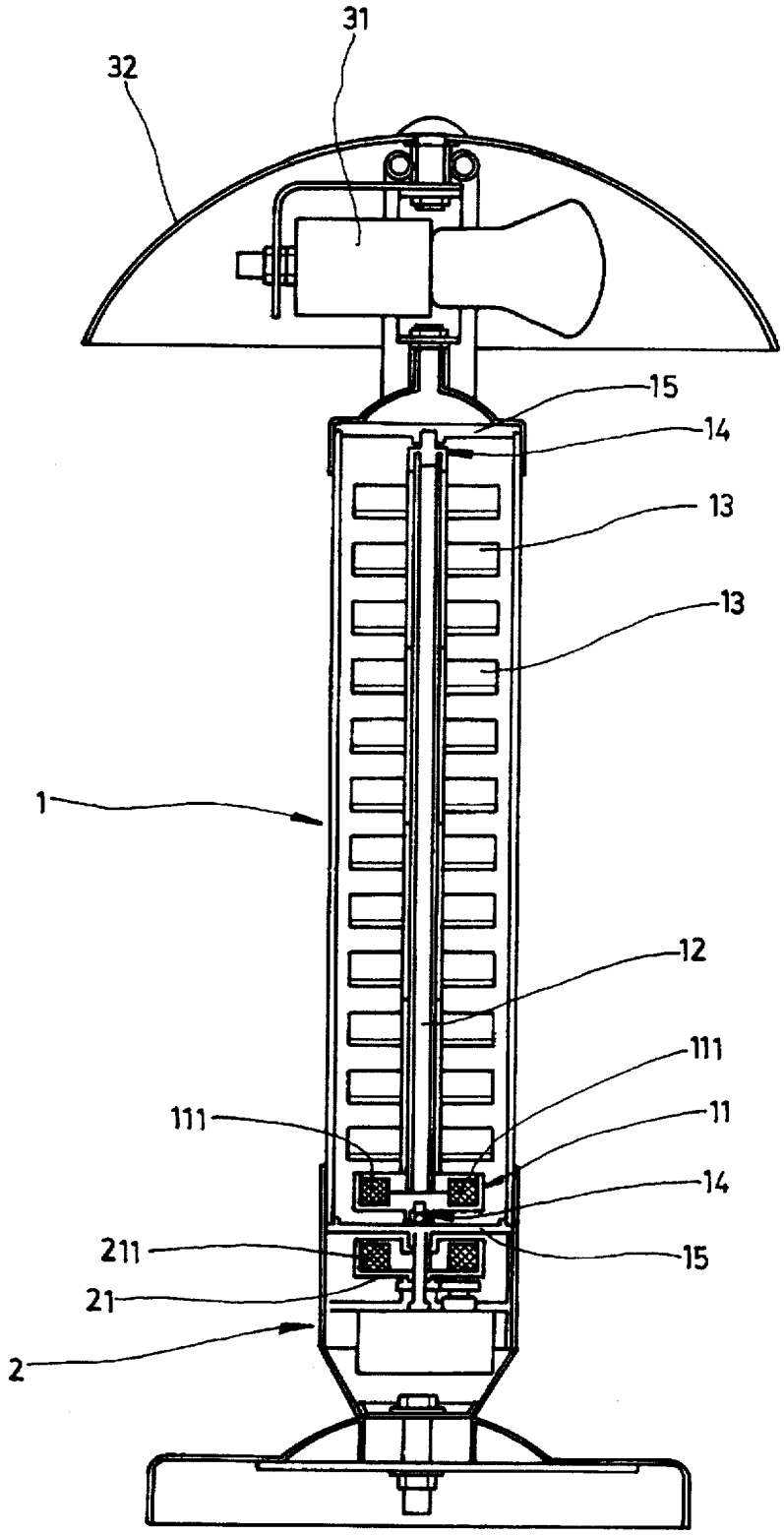
FIG. 4 is a side sectional view of the lamp stand of FIG. 1.

To use a lamp with the stand of the present invention, connect the wire to an external power source or turn on a switch on the lamp, and the liquid in the container is caused to gently flow just like flowing cloud or floating mists, as illustrated in FIGS. 1 and 2. The resultant flowing cloud or floating mists have irregular and changeful forms, providing a beautiful view under the light emitted from the lamp.

Figure 5:
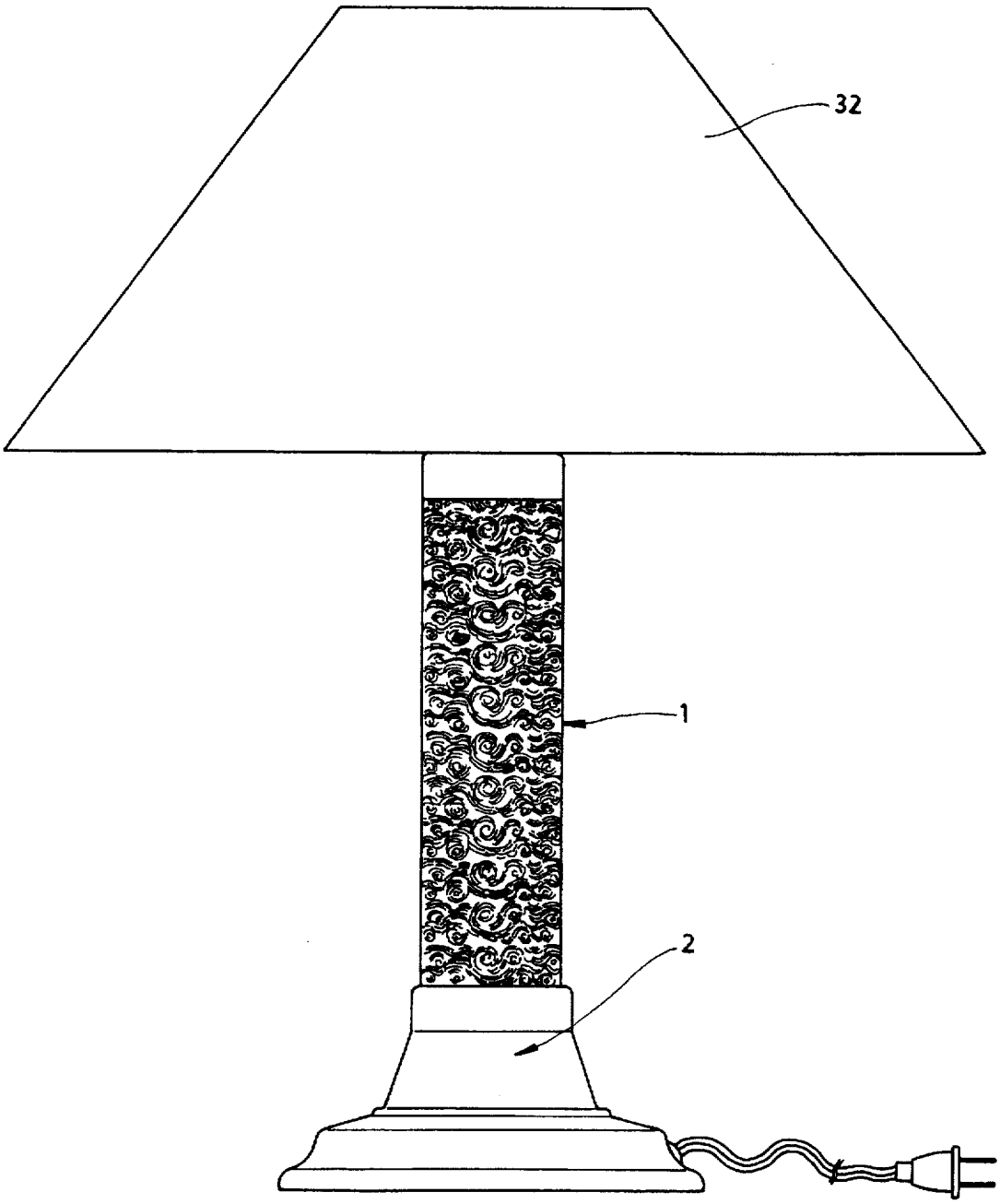
FIG. 5 is a front elevational view of a second embodiment of the lamp stand of the present invention.
Figure 6:
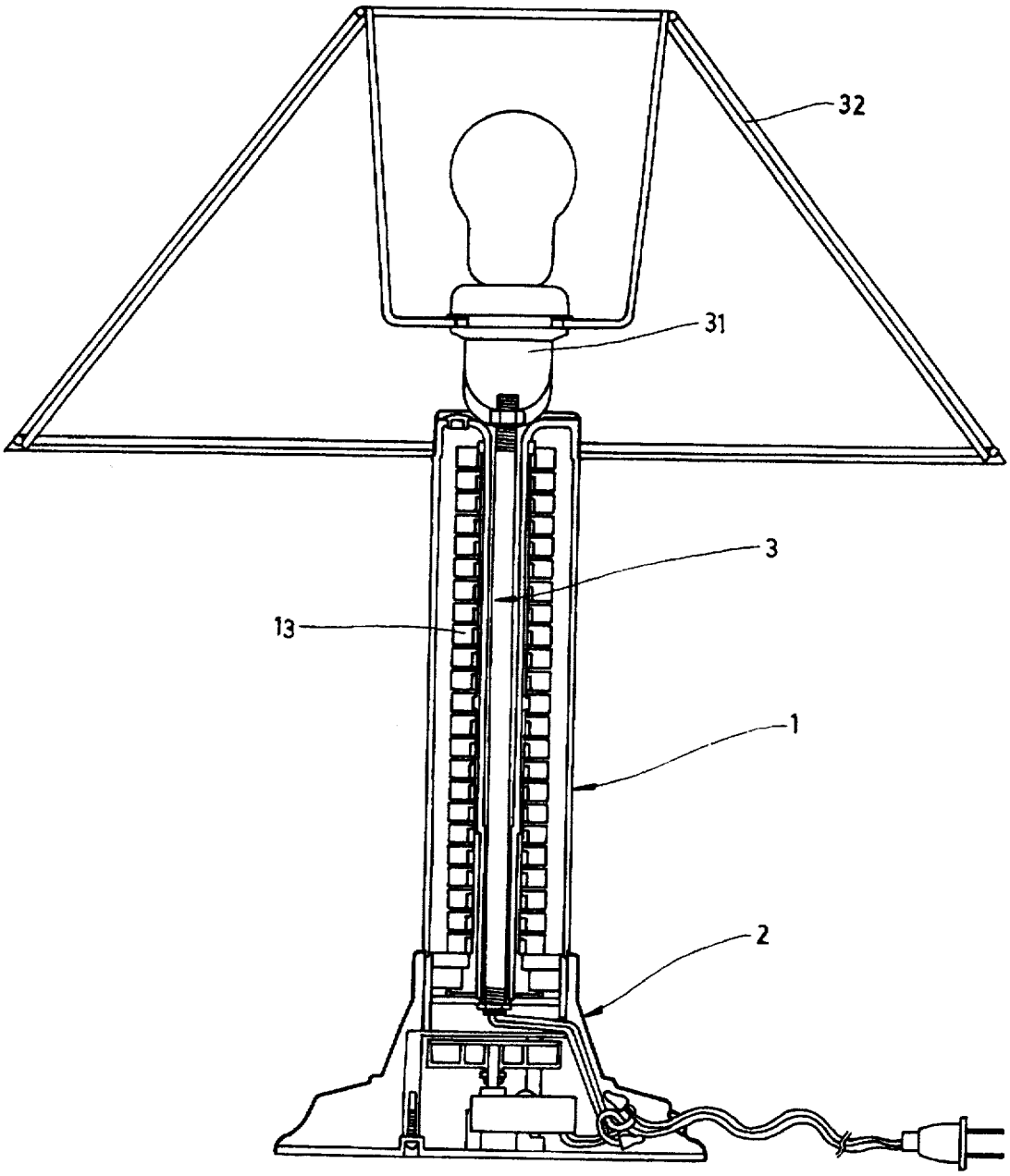
FIG. 6 is a front sectional view of the lamp stand of FIG. 5.
Figure 7:
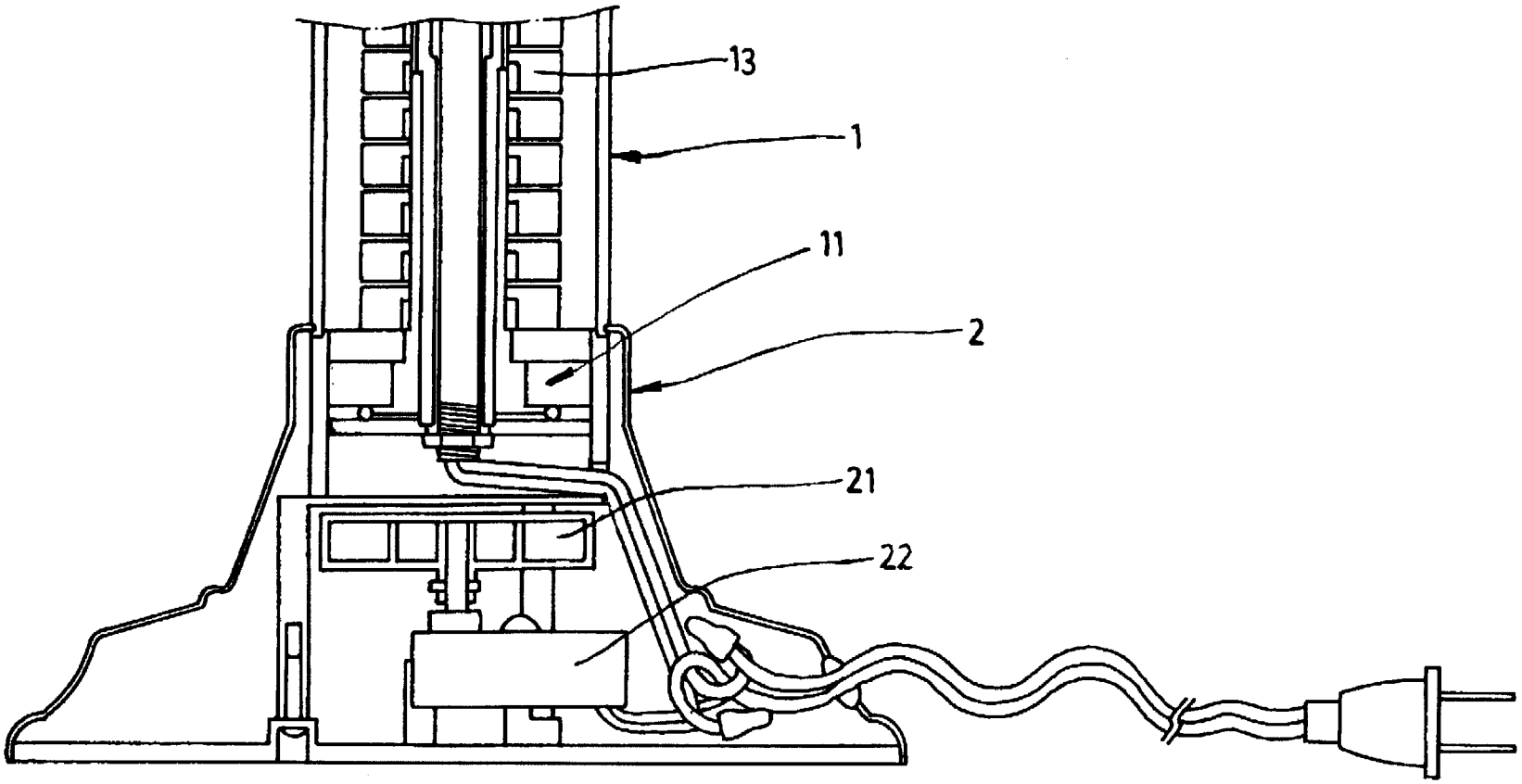
FIG. 7 is a fragmentary, enlarged, sectional view of FIG. 5 showing the structure of the lower seat of the lamp stand according to the second embodiment of the present invention.

FIGS. 5, 6 and 7 illustrate another embodiment of the present invention in which the supporting members 3 are disposed in a central hollow space defined by a long tubular container 1 having an annular cross section. The container 1 itself is still a closed container for filling with some liquid but has a central hollow tube formed therein. The supporting members 3 pass through the central hollow tube instead of being disposed outside the container 1. The rotational shaft 12 is also changed to have an annular cross section so that it may be stably but rotatably put around the central hollow tube of the container 1 and be located thereat. The blades 13 are similarly arranged on the rotational shaft 12 as they are in the first embodiment. To permit the supporting members and the electric wires to upward extend through the central hollow tube of the container 1, the correspondingly disposed driven and driving magnetic rotational members 11, 21 must be so disposed that an adequate clearance is left between them to allow the wires to pass between them before the wires are led into the central hollow tube, as shown in FIG. 6. Since it is not difficult to form the annular cross-sectioned rotational shaft 12 and to rotatably put it around the central hollow tube of the container 1 for causing cloud-like currents in the liquid in the container 1, and the purpose, function, and adopted technical means thereof are the same as those of the first embodiment of the present invention, this second embodiment should be included in the scope of the present invention and be protected.

Figure 8:
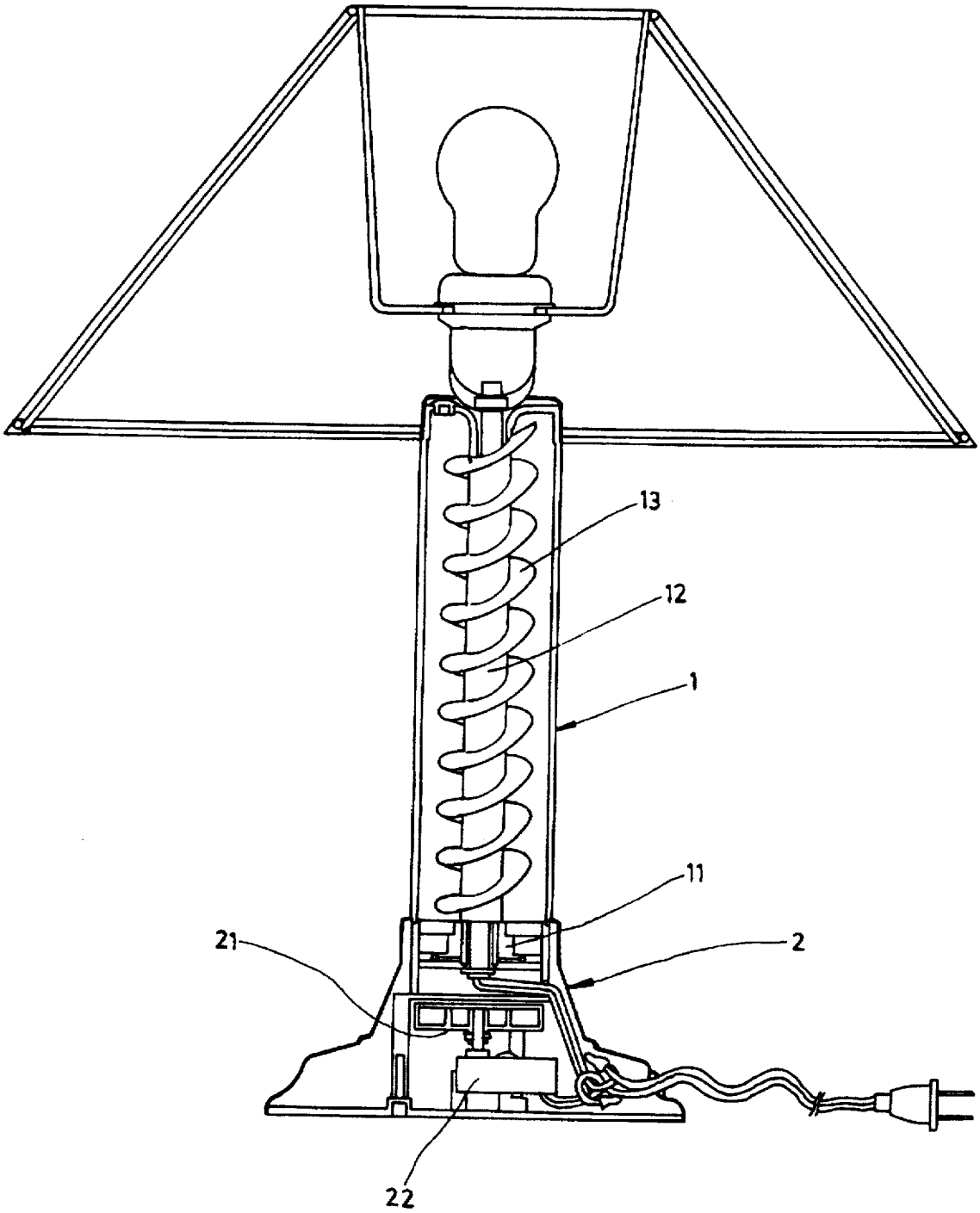
FIG. 8 is a front sectional view of a third embodiment of the present invention.

FIG. 8 illustrates another variant of the second embodiment. In this embodiment, the blades 13 on the rotational shaft 12 are changed into a spiral blade which provides the same stirring effect in the liquid in the container 1.

Figure 9:
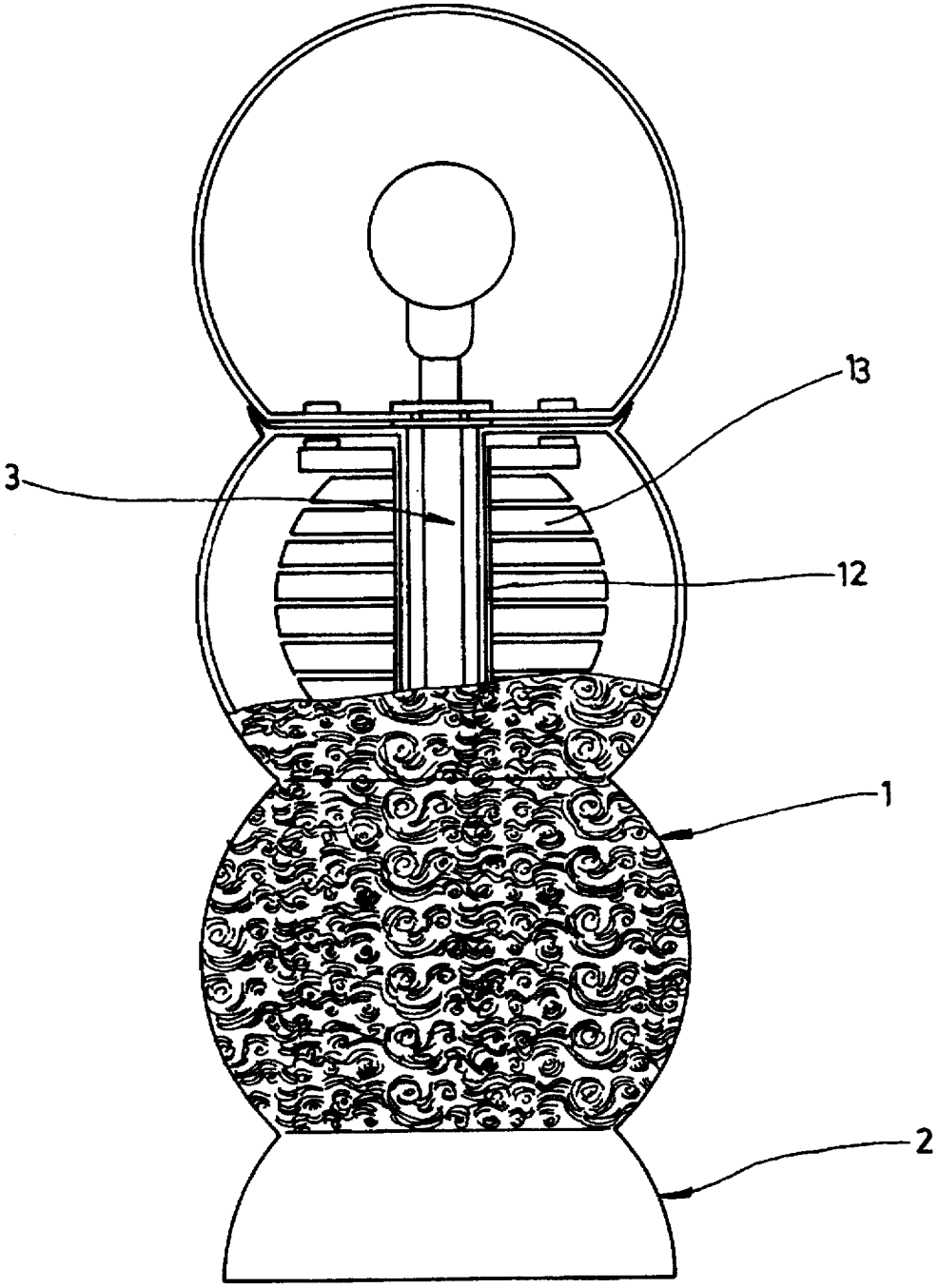
FIG. 9 is a front view of a fourth embodiment of the present invention, a part thereof is cut away to show the inner structure of the liquid container.

FIG. 9 illustrates a further embodiment of the present invention. In this embodiment, the container 1 has a configuration different from the tubular shape in other embodiments without affecting the function of the present invention when the rotational members 11, 21 well cooperate with each other and the rotational shaft 12 and the blades 13 can be easily rotatably mounted in the container 1 to achieve the stirring effect.

What is claimed is:

1. A lamp stand comprising:

a) a closed tubular container having first and second ends, said tubular container filled with a liquid capable of exhibiting cloud-like currents;

b) a light bulb socket located at the first end of the tubular container;

c) a lower seat located on the second end of the tubular container, the lower seat enclosing a rotatable magnetic driving member;

d) a magnetic driven member rotatably located in the tubular container at the second end adjacent to the magnetic driving member such that rotation of the magnetic driving member causes rotation of the magnetic driven member;

e) an elongated rotational shaft extending from the magnetic driven member substantially to the first end of the tubular container such that the elongated rotational shaft rotates with the magnetic driven member; and, f) at least one blade extending from the elongated rotational shaft such that rotation of the elongated rotational shaft causes the liquid to exhibit cloud-like currents.

2. The lamp of claim 1 further comprising an electric motor located in the lower seat and drivingly connected to the magnetic driving member.

3. The lamp of claim 1 further comprising at least one supporting member connected to the lower seat and to the light bulb socket to support the light bulb socket.

4. The lamp of claim 3 wherein the at least one supporting member is located externally of the tubular container.

5. The lamp of claim 3 wherein the elongated rotational shaft is hollow and wherein the at least one supporting member extends through the hollow elongated rotational shaft.

6. The lamp of claim 1 further comprising a plurality of blades extending from the elongated rotational shaft.

7. The lamp of claim 1 wherein the at least one blade comprises a helical blade.

* * * * *